United States Patent [19]

Green et al.

[11] 4,163,452

[45] Aug. 7, 1979

[54] TOBACCO-SMOKE FILTERS

[75] Inventors: John D. Green, Romsey; Ian R. Harris, Alton, both of England

[73] Assignee: British-American Tobacco Company Limited, London, England

[21] Appl. No.: 856,344

[22] Filed: Dec. 1, 1977

[51] Int. Cl.[2] ..... A24B 15/27; B01D 27/02

[52] U.S. Cl. ..... 131/10 A; 131/10.7; 131/10.9; 131/265; 55/74

[58] Field of Search ..... 131/261, 262, 263, 264, 131/265, 10 A, 10.5, 10 R, 10.7, 10.9, 268, 269; 55/74

[56] References Cited

U.S. PATENT DOCUMENTS 3,359,988 12/1967 Thomson ..... 131/261 R 3,390,688 7/1978 Touey et al. ..... 131/266

FOREIGN PATENT DOCUMENTS 1235880 6/1971 United Kingdom ..... 131/262 R

*Primary Examiner*—Robert W. Michell

*Assistant Examiner*—Thomas Wallen

*Attorney, Agent, or Firm*—Kane, Dalsimer, Kane, Sullivan & Kurucz

[57] ABSTRACT

An improved tobacco-smoke filter or filter material contains granules of porous activated carbon to which has been applied a nitroxide of the group consisting of the nitroxide 4-oxo-2,2,6,6-tetramethylpiperidino-oxy, the nitroxide 1-nitronyl-3-oxyl-4,4,5,5-tetramethyl-2-phenyldihydroimidazole and mixtures thereof. The carbon may be loaded with 0.5 to 25%, suitably 1.0 to 15%, by weight of the nitroxide. Advantageously such a filter has provision for filter ventilation. For instance, in a triple filter with a center section containing the treated carbon, the said center section and/or the section upstream thereof is ventilated.

11 Claims, No Drawings

TOBACCO-SMOKE FILTERS

This invention concerns improvements relating to filters or filter material for tobacco smoke, especially though not exclusively to cigarette filters.

Filters made from fibrous or filamentary material such as paper or cellulose acetate are known to remove the particulate matter from tobacco smoke. Some other components of tobacco smoke, such as aldehydes, cyanides, sulphides and oxide, can be removed to some extent by adsorption or absorption on a surface or by chemical reaction. One of these vapour-phase constituents which has been found to be difficult to remove from tobacco smoke is nitric oxide. Nitric oxide is a substance which belongs to a group of molecules of an electronic constitution such that there is present an unpaired electron, which gives nitric oxide a free-radical character.

According to the present invention, a tobacco-smoke filter or filter material contains granules of porous activated carbon to which the nitroxide 4-oxo-2,2,6,6-tetramethylpiperidino-oxy and/or the nitroxide 1-nitronyl-3-oxyl-4,4,5,5-tetramethyl-2-phenyldihydroimidazole has been applied. Both compounds are stable, non-volatile, free-radical nitroxides.

By such a filter or material, a considerable filtration efficiency for nitric oxide (NO) in particular and for other constituents which it may be desired to remove, can be obtained without disadvantageous concomitant effects. It is believed that the reduction in nitric oxide may be linked with the porosity of the treated carbon and that, desirably, the pore volume should be at least 0.2 cc/g and the surface area of the said carbon at least 50 $m^2/g$. The preferred compound 4-oxo-2,2,6,6-tetramethylpiperidino-oxy, has the structural formula:

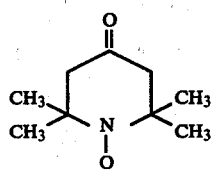

The level of loading of the nitroxide carbon expressed as a percentage by weight of the untreated carbon, may be from 0.5 to 25% and is preferably within the range of 1.0 to 15%. In commercial practice, the loading level will probably be within the range of 3 to 10%.

EXAMPLE 1

1 g of activated carbon in porous granular form of the type supplied under the trade description "BPL" by the Pittsburg Activated Carbon Co. was added to a solution of 100 mg of 4-oxo-2,2,6,6-tetramethylpiperidino-oxy in 5 ml of ethanol. The solvent was allowed to evaporate at room temperature until the granular carbon was dry and free-flowing. This gave a loading level of approximately 10%. A triple filter containing a bed composed of 100 mg of this treated carbon disposed between two sections of cellulose acetate, each 5 mm long, was attached to a cigarette having a filling of flue-cured tobacco. On smoking the cigarette through this filter, 72% by weight of nitric oxide was removed from the tobacco smoke.

Tests were carried out with a number of available granular activated carbons and with different loadings of the same nitroxide as in Example 1, using the same application procedure as in that Example. The results are as tabulated below:

| CARBON | LOADING (% by weight) | NO Filtration Efficiency (%) Carbon with nitroxide | NO Filtration Efficiency (%) Carbon without nitroxide |
|---|---|---|---|
| BPL | 10 | 72 | less than 10 |
| BPL | 5 | 60 | less than 10 |
| Anthrasorb CC1430/70 | 10 | 68 | less than 10 |
| MF3 | 10 | 57 | 13 |
| Actibon X | 10 | 45 | less than 10 |
| Picatif 60143 | 7 | 43 | less than 10 |
| Carbomafra GC | 7 | 43 | less than 10 |
| 207C | 10 | 43 | less than 17 |

The suppliers of the several types of carbon were as follows:

| | |
|---|---|
| BPL | Pittsburgh Activated Carbon Co., of Pennyslvania, U.S.A. |
| Anthrasorb CC1430/70 | Cardian Chemical Co., of Cheltenham, England. |
| MF3 | Chemviron Ltd., of Brussels, Belgium. |
| Actibon X | Hooker - Mexicana S.A. de C.V., of Mexico. |
| Picatif 60143 | Pica, of Paris, France. |
| Carbomafra GC | British Traders & Shippers Ltd., of Dagenham, England |
| 207C | Sutcliffe - Speakman Ltd., of Leigh, Lancashire, England. |

Actibon X was rendered non-acidic, before application, by treatment with a 0.1 M aqueous solution of sodium hydroxide.

EXAMPLE 2

1-nitronyl-3-oxyl-4,4,5,5-tetramethyl-2-phenyldihydroimidazole was applied to carbon granules of the type BPL referred to above, using the same procedure as in Example 1, but with a loading level of 5%. A triple filter was prepared as described in that example. A filtration efficiency for nitric oxide of 44% was obtained.

The amount of treated carbon to be provided in a filter will depend upon the filtration efficiency required as well as upon the nitroxide used. The effect of variation of the weight of treated carbon is illustrated by the table below: The results tabulated were obtained with the Anthrasorb type of granular carbon, referred to above, treated as described in Example 1 but with a loading level of 7% of the 4-oxo-2,2,6,6-tetramethylpiperidino-oxy nitroxide. The treated carbon was incorporated in triple filters as described in that Example.

| WEIGHT OF CARBON (mg) | FILTRATION EFFICIENCY (%) For NO |
|---|---|
| 25 | 29 |
| 50 | 50 |
| 75 | 50 |
| 100 | 61 |
| 150 | 75 |
| 200 | 81 |

The efficiency of filtration for nitric oxide can be enhanced by so called "ventilation" of the filter, for example by use of a perforated or porous filter wrapper. Thus, if, in a triple filter whose centre section comprises a bed of the treated carbon, either the tobacco-end section or the said centre section is ventilated in known manner, the filtration efficiency of the filter is significantly increased. For example, a triple filter of this kind with ventilation holes in the wrapping of the centre section was attached to cigarettes of flue-cured tobacco. There were 3 rows of holes 1 mm apart, the holes being rectangular (0.1 mm×0.5 mm) and the first row being 7 mm from the end of the tobacco rod. 100 mg of carbon of the Anthrasorb type with 10% loading of the 4-oxo-2,2,6,6-tetramethylpiperidino-oxy nitroxide was employed as the aforesaid bed. With the ventilation holes closed by covering with non-porous tape, the overall reduction of nitric oxide was found to be 67% whereas, with the holes uncovered, the overall reduction was 89%.

We claim:

1. An improved tobacco-smoke filter or filter material containing granules of porous activated carbon to which a nitroxide of the group consisting of the nitroxide 4-oxo-2,2,6,6-tetramethylpiperidino-oxy, the nitroxide 1-nitronyl-3-oxyl-4,4,5,5-tetramethyl-2-phenyldihydroimidazole and mixtures thereof has been applied.

2. A filter or filter material according to claim 1, wherein the carbon is loaded with 0.5 to 25% by weight of the nitroxide.

3. A filter or filter material according to claim 1, wherein the carbon is loaded with 1.0 to 15% by weight of the nitroxide.

4. A sectional filter according to claim 1, wherein a bed of the treated carbon forms one section of the filter which has at least one other section of different smoke-filtering material.

5. A sectional filter according to claim 1, wherein a bed of the treated carbon is located between two other sections of smoke-filtering material.

6. A sectional filter according to claim 1, wherein a bed of the treated carbon forms one section of the filter, of which at least one other section is of fibrous or filamentary material.

7. A sectional filter according to claim 1, wherein a bed of the treated carbon forms one section of the filter, of which at least one other section is of cellulose acetate.

8. A filter according to claim 1 and having provision for filter ventilation.

9. A filter according to claim 1, being a triple filter of which the centre section contains the treated carbon and the said centre section and/or the section upstream thereof is ventilated.

10. A smoking article provided with a filter material according to claim 1.

11. A method for improving a tobacco-smoke filter or filtration material containing granules of porous activated carbon which comprises applying to the said carbon a nitroxide of the group consisting of the nitroxide 4-oxo-2,2,6,6-tetramethylpiperidino-oxy, the nitroxide 1-nitronyl-3-oxyl-4,4,5,5-tetramethyl-2-phenyldihydroimidazole and mixtures thereof.

* * * * *